US010689996B2

(12) United States Patent
Notarianni et al.

(10) Patent No.: US 10,689,996 B2
(45) Date of Patent: Jun. 23, 2020

(54) TURBOMACHINE BLADE FITTED WITH AN ELASTOMER GASKET

(71) Applicant: SAFRAN AIRCRAFT ENGINES, Paris (FR)

(72) Inventors: Gilles Pierre-Marie Notarianni, Brie-Comte-Robert (FR); Audrey Laguerre, Shanghai (CN); Stephane Roger Mahias, Montrouge (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 448 days.

(21) Appl. No.: 15/625,211

(22) Filed: Jun. 16, 2017

(65) Prior Publication Data

US 2017/0362950 A1 Dec. 21, 2017

(30) Foreign Application Priority Data

Jun. 16, 2016 (FR) ..... 16 55595

(51) Int. Cl.

| | |
|---|---|
| ***F01D 11/00*** | (2006.01) |
| ***F04D 29/32*** | (2006.01) |
| ***F04D 29/08*** | (2006.01) |
| ***F01D 5/28*** | (2006.01) |

(52) U.S. Cl.

CPC ..... *F01D 11/008* (2013.01); *F01D 5/282* (2013.01); *F04D 29/083* (2013.01); *F04D 29/322* (2013.01); *F05D 2240/30* (2013.01); *F05D 2240/55* (2013.01); *F05D 2300/43* (2013.01); *F05D 2300/603* (2013.01)

(58) Field of Classification Search

CPC ..... F01D 11/008; F01D 5/30; F01D 5/3007

See application file for complete search history.

(56) References Cited

U.S. PATENT DOCUMENTS

| | | | | |
|---|---|---|---|---|
| 5,464,326 | A | 11/1995 | Knott | |
| 6,632,070 | B1 * | 10/2003 | Tiemann | F01D 5/141 415/191 |
| 8,523,189 | B2 * | 9/2013 | Harper | F01D 11/008 277/650 |
| 9,228,444 | B2 * | 1/2016 | Evans | F01D 5/225 |
| 9,297,268 | B2 * | 3/2016 | Alarcon | F01D 11/008 |
| 9,650,902 | B2 * | 5/2017 | Billings | F01D 5/3007 |
| 2012/0244007 | A1 | 9/2012 | Mason | |
| 2014/0169979 | A1 | 6/2014 | Alarcon et al. | |

FOREIGN PATENT DOCUMENTS

| | | |
|---|---|---|
| GB | 1 331 209 | 9/1973 |
| WO | WO 93/22539 | 11/1993 |

OTHER PUBLICATIONS

French Preliminary Search Report dated Feb. 10, 2017 in French Application 16 55595 filed on Jun. 16, 2016 (with English Translation of Categories of Cited Documents).

* cited by examiner

*Primary Examiner* — Justin D Seabe

(74) *Attorney, Agent, or Firm* — Oblon, McClelland, Maier & Neustadt, L.L.P.

(57) ABSTRACT

A turbomachine blade (10) comprising a body (11) and an elastomer gasket (12) fastened to said body (11).

8 Claims, 4 Drawing Sheets

TURBOMACHINE BLADE FITTED WITH AN ELASTOMER GASKET

FIELD OF THE INVENTION

The invention relates to a turbomachine blade, to a rotor wheel fitted with such a blade, and to a turbomachine fitted with such a rotor wheel. In particular, the rotor wheel may optionally be a turbojet fan.

STATE OF THE PRIOR ART

Structures for defining the gas passage in leaktight manner at the root of a blade within a rotor wheel generally comprise an inter-blade platform provided with a gasket that co-operates with the blade. Such a structure is described in Document FR 2 987 086.

Nevertheless, it can happen that the gasket no longer performs its sealing function correctly, e.g. in the event of the gasket turning over. There therefore exists a need in this sense.

SUMMARY OF THE INVENTION

An embodiment provides a turbomachine blade comprising a body and an elastomer gasket fastened to said body.

It can be understood that the body of the blade comprises all of the blade other than the gasket. In particular, the body comprises a blade root and an airfoil.

By providing a gasket on the blade rather than on an adjacent platform, the gasket is less likely to turn over in such a manner as to lose its sealing function. Specifically, in the rotor wheel fitted with said blade, the gasket co-operates with a portion that extends circumferentially (as contrasted with a portion that extends radially in the prior art), thereby making it easier to avoid unacceptable deformation of the gasket.

Furthermore, by providing a gasket on the blade rather than on the platform, the gasket can extend continuously over the entire periphery of the blade, thereby improving sealing.

In certain embodiments, the gasket is configured to co-operate with an inter-blade platform.

This ensures that the portion of the rotor wheel with which the gasket needs to co-operate does indeed extend in the circumferential direction, thereby ensuring better sealing. For example, the gasket is configured to co-operate with a surface of a plate of a platform.

In certain embodiments, the blade extends in a height direction and presents, in the height direction, a root and an airfoil, the gasket being arranged on the root and extending in a direction that is substantially perpendicular to the height direction.

It can be understood that the height direction of the blade corresponds to a radial direction within a rotor wheel fitted with said blade. Furthermore, the term "direction substantially perpendicular to the height direction" should be understood as "direction forming an angle lying in the range 45° to 90° with the height direction". It can also be understood that the gasket is a linear gasket.

By arranging the gasket on the blade root, it is ensured that it does not disturb proper operation of the airfoil (i.e. does not disturb the flow of gas along the airfoil, in operation).

In certain embodiments, the gasket extends around the entire perimeter of the blade.

This makes it possible for the gasket to provide sealing around the entire perimeter of the blade. Sealing is thus improved.

In certain embodiments, the gasket presents a linear base and a linear lip extending from the linear base, the base being fastened on the blade while the distal end of the lip presents a flyweight.

In other words, the gasket is a linear gasket. It can be understood that the lip is connected to the base of the gasket while the distal end of the lip is configured to co-operate with a surface of a rotor wheel, e.g. a plate of a platform, so as to provide sealing between the blade and said surface. In operation, the flyweight serves to ensure that the distal end of the lip is pressed against said surface by the inertia effect. For example, the flyweight may be formed by extra thickness of the gasket at the distal end of the lip, e.g. by a linear rib. In another example, a linear metal portion may be embedded in the distal end of the lip.

In certain embodiments, the gasket is bonded to the body.

It can be understood that the gasket can be bonded with an adhesive, or by vulcanization against the surface of the blade, or by being co-cured with the blade if the blade is made of composite material, e.g. while polymerizing the composite matrix of the blade, or by any other means known to the person skilled in the art.

Such a fastening technique serves to ensure complete sealing between the gasket and the body of the blade, hereby further improving the effectiveness of the gasket.

In certain embodiments, the body is made of composite material.

The fastening of the gasket by adhesive bonding is particularly strong when the body of the blade is made of composite material.

In a first variant, the blade extends in a height direction and presents, in the height direction, a root and an airfoil, with the lip extending towards the free end of the root when considered in the height direction.

It can thus be understood that the lip forms an angle lying in the range 0° to 90° with a plane perpendicular to the height direction, and extends beside the root, relative to that plane. Furthermore, such a shape provides the gasket with great robustness against any risk of turning over.

In a second variant, the blade extends in a height direction and presents, in the height direction, a root and an airfoil, with the lip extending towards the free end of the airfoil when considered in the height direction.

It can thus be understood that the lip forms an angle lying in the range 0° to 90° with a plane perpendicular to the height direction, extending beside the airfoil relative to that plane. Such a structure presents the advantage of being capable of being retracted completely under the platform so as not to project into the gas passage.

An embodiment also provides a rotor wheel having at least one blade in accordance with any of the embodiments described in the present disclosure.

For example, the rotor wheel comprises a disk having a plurality of blades mounted at its periphery, which blades may optionally be identical, and a plurality of inter-blade platforms, which platforms may optionally be identical.

It can be understood that the rotor wheel extends in an axial direction, a radial direction, and a circumferential direction. In general manner, the axial direction corresponds to the direction of the axis of rotation of the rotor wheel, and a radial direction is any direction perpendicular to the axial direction. The circumferential direction corresponds to a direction describing a ring around the axial direction. The axial, radial, and circumferential directions correspond respectively to the directions defined by the z-coordinate, the radius, and the angle in a cylindrical coordinate system. Naturally, the height direction of each of the blades corresponds to a radial direction of the rotor wheel.

In certain embodiments, the rotor wheel has an inter-blade platform adjacent to said blade, in which the platform presents a plate extending circumferentially while the gasket extends under said plate, considered in a radial direction.

The term "under" should be understood as meaning that the gasket is radially closer to the axis of the rotor wheel than the plate. Thus, in general manner in the present description, and unless specified to the contrary, terms such as "over"/"under" should be understood as radially further away from or closer to the axis of the rotor wheel. Likewise, unless specified to the contrary, the adjectives "inner" and "outer" are used relative to a radial direction such that an inner portion (i.e. the radially inner portion) of an element is closer to the axis of the rotor wheel than an outer portion (i.e. radially outer portion) of the same element.

Such a configuration makes it possible to ensure that the gasket is pressed well against the underside of the plate and co-operates properly therewith, which underside forms a surface extending circumferentially inside the rotor wheel so that the gasket does not interfere with the flow of gas through the passage defined by the blades and the platforms.

In certain embodiments, the inter-blade platform has a second linear gasket fastened to the plate, said second gasket being configured to co-operate with said blade, with the second gasket extending between the gasket of the blade and the platform when considered in the radial direction.

In other words, the second gasket is under the plate, while the gasket of the blade is under the second gasket. It can be understood that the gasket of the blade forms a first gasket while the gasket of the platform forms a second gasket. These two gaskets form a double barrier for opposing gas leakage and they provide good sealing.

An embodiment also provides a turbomachine including a rotor wheel in accordance with any of the embodiments described in the present disclosure.

BRIEF DESCRIPTION OF THE DRAWINGS

The invention and its advantages can be better understood on reading the following detailed description of various embodiments of the invention given as non-limiting examples. The description is made with reference to the sheets of the accompanying figures, in which.

DETAILED DESCRIPTION OF EMBODIMENTS

Figure 1:
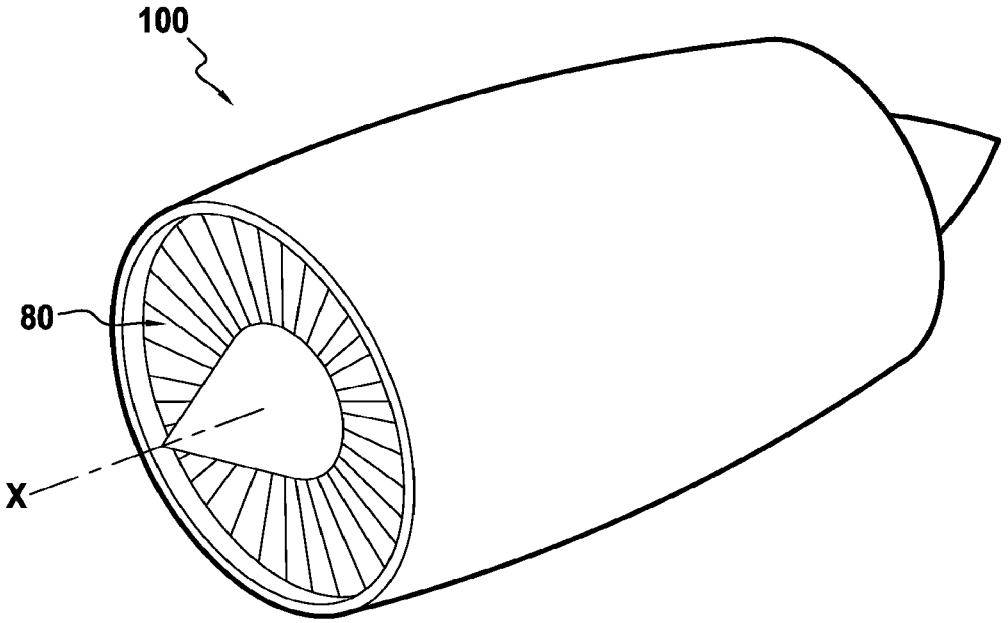
FIG. 1 shows a turbojet presenting a fan.
Figure 2:
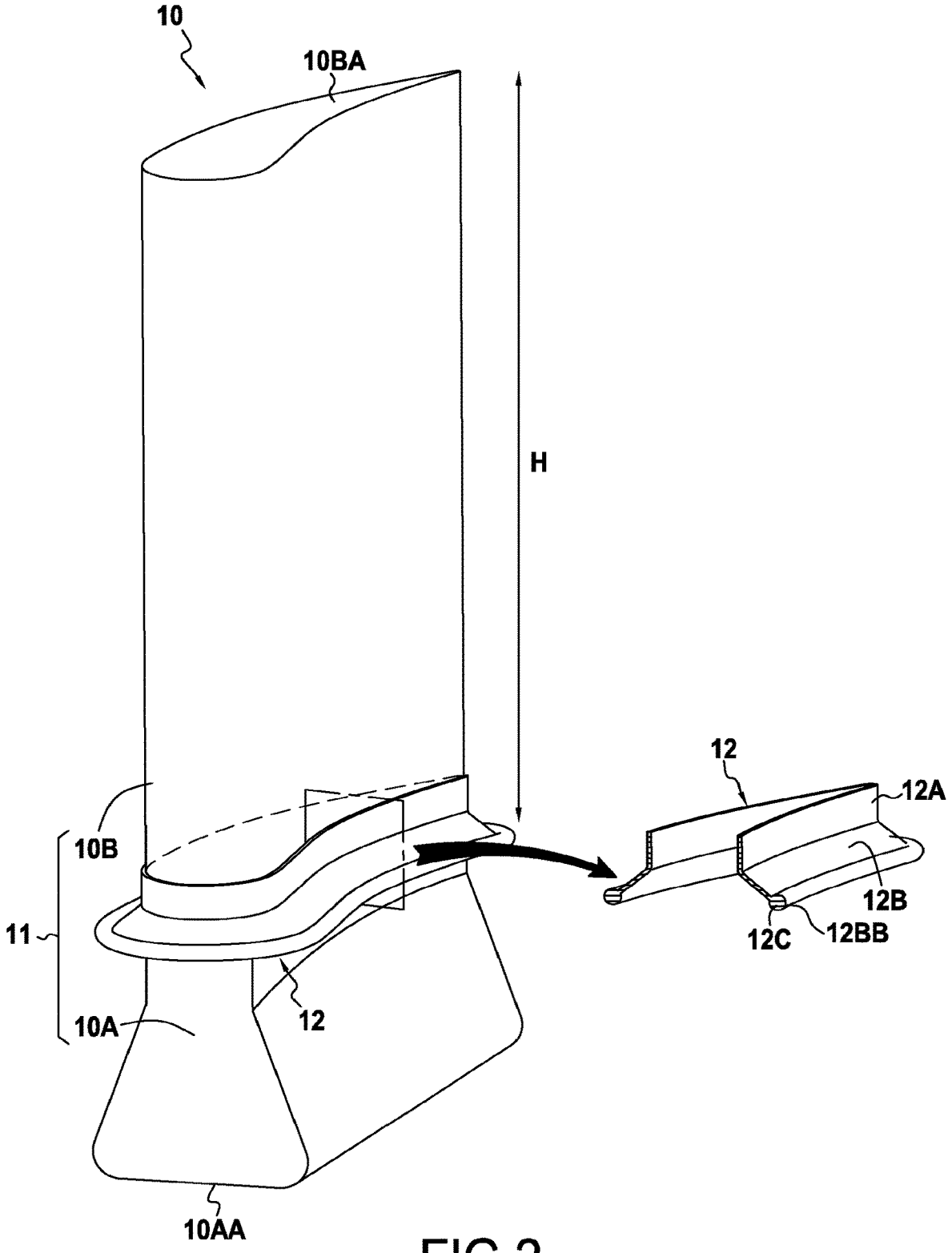
FIG. 2 shows a blade in a first embodiment.
Figure 4:
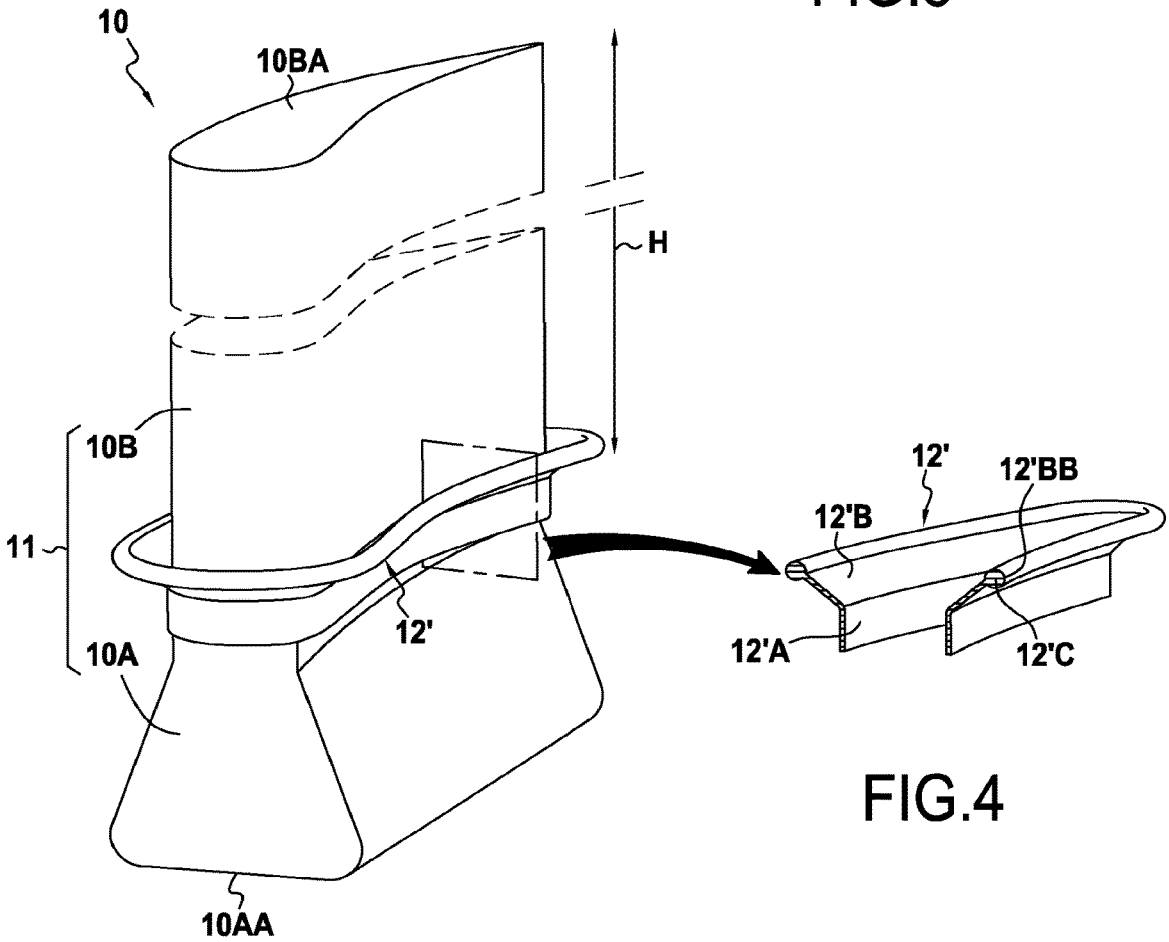
FIG. 4 shows a blade in a second embodiment.

FIG. 1 shows a turbomachine 100, specifically a turbojet 100 having a rotor wheel 80, specifically a fan 80, fitted with blades 10 as shown in FIG. 2 or in FIG. 4. In this example, all of the blades 10 and all of the platforms 20 of the fan 80 are identical.

With reference to FIG. 2, the blade 10 extends in a height direction H, and in its height direction it presents a root 10A surmounted by an airfoil 10B, the root 10A and the airfoil 10B forming the body 11 of the blade 10. In this example, the body 11 is made of composite material. In the height direction H, the root 10A presents a free end 10AA, and the airfoil 10B presents a free end 10BA. An elastomer gasket 12 is fastened to the body 11, and in this example to the root 10A. The gasket 12 is linear and extends perpendicularly to the height direction H. The gasket 12 extends over the entire periphery of the root 10A, naturally considered perpendicularly to the height direction H.

The gasket 12 presents a linear base 12A and a linear lip 12B connected to the base 12A. The gasket 12 is fastened to the body via its base 12A, which base is adhesively bonded to the body 11. A linear rib 12C is formed on the distal end 12BB of the lip 12B, thus forming a flyweight. In this example, the rib 12C is in the form of a cylindrical bead centered on the distal end of the lip 12B. The lip 12B extends in the height direction H towards the free end 10AA of the root 10A (i.e. radially towards the inside of the wheel 80, see FIG. 3). In this example, the lip 12B extends beside the root 10A relative to the base 12A.

Figure 3:
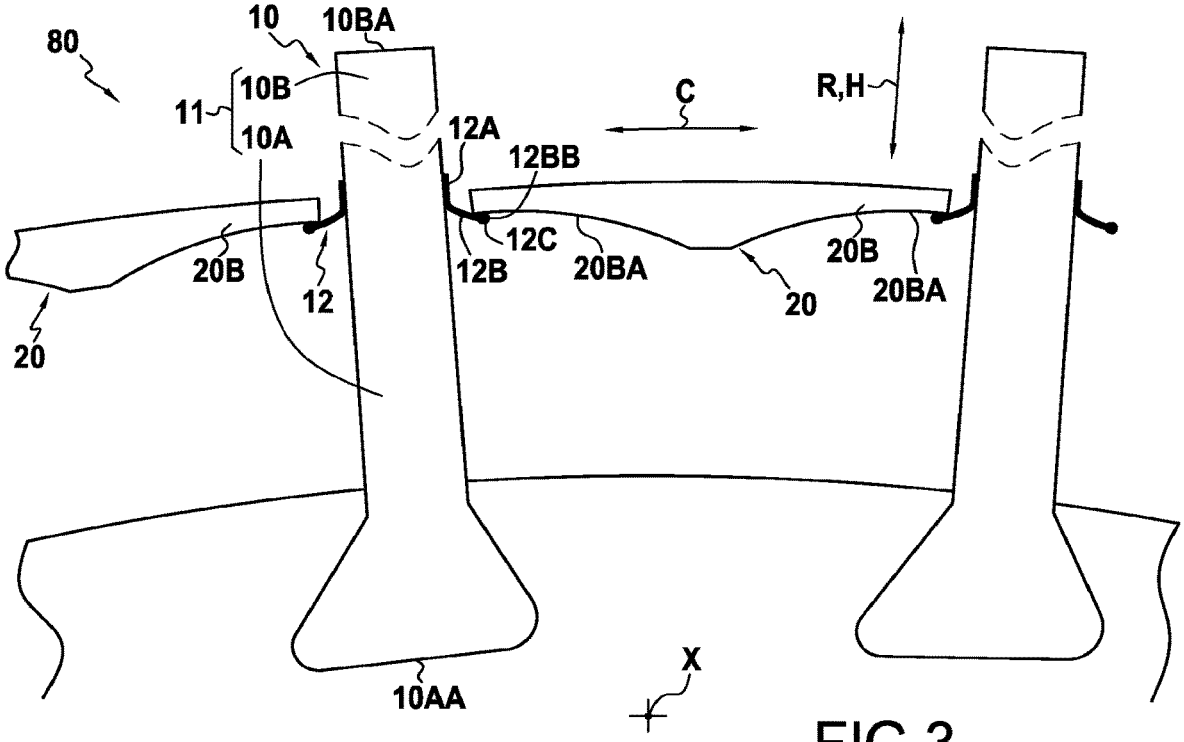
FIG. 3 is a fragmentary section view of the FIG. 1 turbojet fan fitted with a blade of the first embodiment.

As shown in FIG. 3, when the blade 10 is mounted in a rotor wheel 80, the height direction H of each blade 10 coincides with a radial direction R of the wheel 80. The rotor wheel 80 thus extends in an axial direction X, a radial direction R, and a circumferential direction C.

The gasket 12 co-operates with two inter-blade platforms 20 that are adjacent to the blade 10. More particularly, each platform 20 presents a plate 20B extending circumferentially, the platform 20 being mounted on the wheel 80 by conventional means (not shown), the gasket 12 co-operating with the inside circumferential surface 20BA of the plate 20B. Thus, the gasket 12 is arranged in the radial direction R below the plate 20B. In operation (i.e. when the wheel 80 is rotating), the rib 12C is pressed against the surface 20BA of the plate 20B by centrifugal forces, thereby ensuring good sealing between the blade 10 and the platform 20 at the blade root, under all circumstances.

In general manner, it can be understood that the gasket 12 is configured to remain in contact with the platform 20, and more particularly with the surface 20BA under all conditions, including at rest when the wheel 80 is not rotating.

Figure 5:
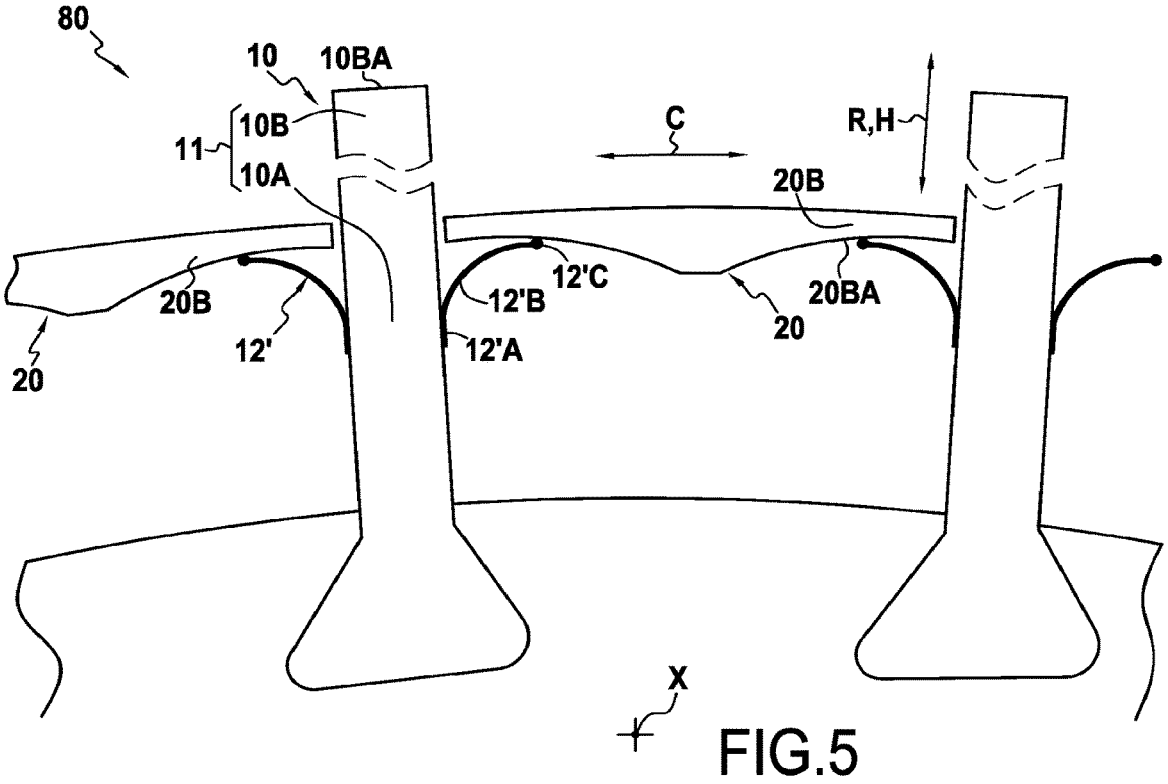
FIG. 5 is a fragmentary section view of the FIG. 1 turbojet fan fitted with a blade of the second embodiment.
Figure 6:
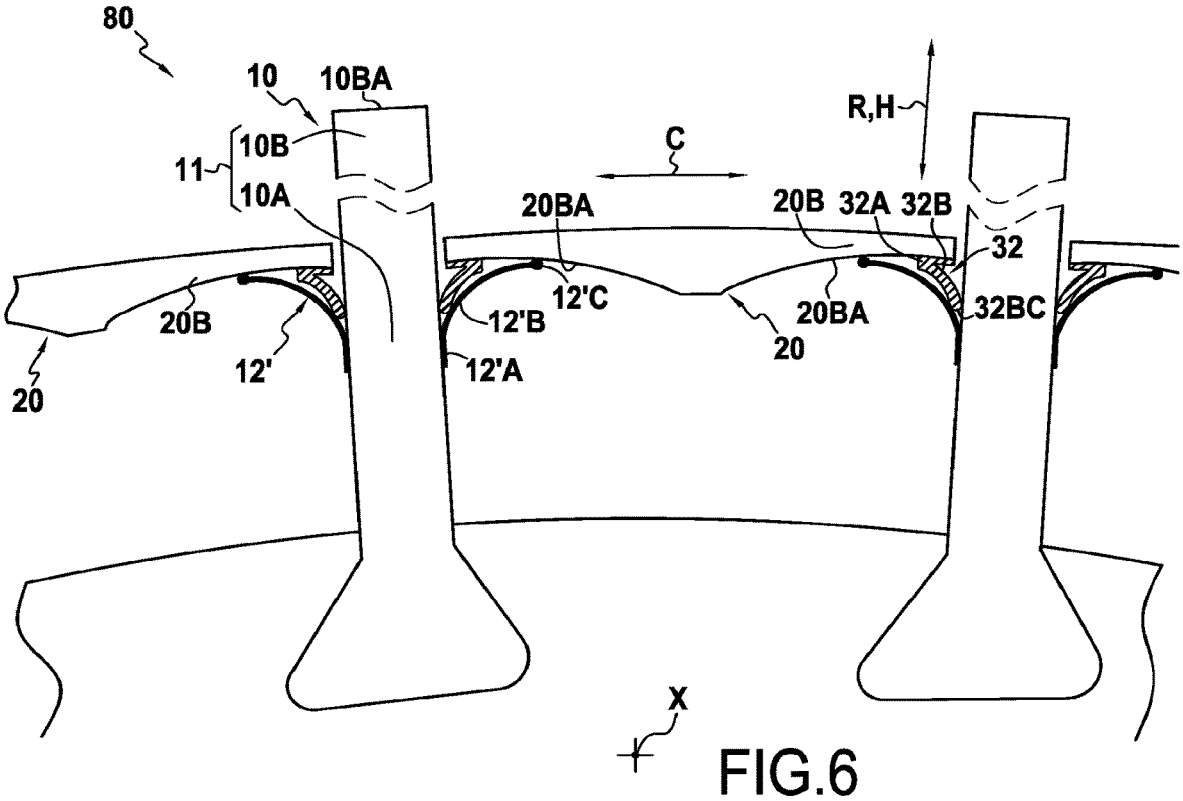
FIG. 6 shows a variant of the FIG. 5 fan.

FIGS. 2 and 3 correspond to the first above-described variant. FIGS. 4, 5, and 6 show a second embodiment of the blade, corresponding to the second above-described variant. The blade in the second embodiment is identical to the blade in the first embodiment, with the exception of the elastomer gasket. Thus, only the reference signs relating to the gasket are modified, the other reference signs remaining unchanged.

In FIGS. 4 and 5, the lip 12'B of the gasket 12' extends in the height direction H towards the free end 10BA of the airfoil 10B (radially towards the outside of the wheel 80). In this example, the lip 12'B extends beside the airfoil 10B relative to the base 12'A. Naturally, when the gasket 12' co-operates with a platform 20, the lip 12'B is folded and deforms elastically in such a manner that the lip 12'B extends substantially in the circumferential direction C of the wheel 80 (i.e. forming an angle lying in the range 0° to 45° relative to the circumferential direction C). More generally, when the blade 10 is mounted in a rotor wheel 80, the gasket 12' co-operates with an inter-blade platform 20 so that the lip 12'B extends substantially perpendicularly to the radial direction R (or the height direction H of the blade 10).

FIG. 6 shows a rotor wheel that is modified relative to the rotor wheel of FIG. 5. The only modification lies in the presence of a second gasket 32 arranged on the inside surface 20BA of the plate 20B of the platform. Thus, compared with FIG. 4, the reference signs for common elements remain unchanged.

The second gasket 32 is arranged radially between the plate 20B and the gasket 12' (or first gasket 12') of the blade 10. In this example, the second gasket 32 is a linear gasket presenting a second liner base 32A fastened to the inside surface 20BA of the plate 20B, and a second linear lip 32B. The second lip 32B extends radially towards the root 10A of the blade 10 (i.e. radially towards the inside of the wheel 80). The distal end 32BA of the second linear lip 32B co-operates with the blade 10. Naturally, the rib 12'C of the first gasket 12' co-operates with the inside surface 20BA. The second lip 32B also co-operates in part with the lip 12'B (or first lip 12'B) of the gasket 12'. Thus, in this example, the second gasket 32 forms firstly a second barrier for improving sealing, and also serves to block the gasket 12' of the blade 10 in position so as to avoid any potential excessive deformation thereof.

Naturally, the present invention is described with reference to specific embodiments, and it is clear that modifications and changes may be made to those embodiments without going beyond the general ambit of the invention as defined by the claims. In particular, individual characteristics of the various embodiments shown and/or mentioned may be combined in additional embodiments. Consequently, the description and the drawings should be considered in a sense that is illustrative rather than restrictive.

For example, the first embodiment blade 10, as shown in FIGS. 2 and 3, could be mounted in a rotor wheel having an inter-blade platform 20 fitted with a gasket 32 as shown in FIG. 6.

The invention claimed is:

1. A rotor wheel comprising:

at least one turbomachine blade, said blade comprising a body and a first elastomer gasket fastened to said body, an inter-blade platform adjacent to said blade, the inter-blade platform is in the form of a plate that extends circumferentially, whereas, considered in a radial direction, the first gasket extends under said plate, the inter-blade platform having a second gasket fastened to the plate, said second gasket being configured to seal a gap between the blade and the inter-blade platform, and when considered in the radial direction, the second gasket extends between the first gasket of the blade and the plate.

2. The rotor wheel according to claim 1, wherein the first gasket is configured to seal the gap between the blade and the inter-blade platform.

3. The rotor wheel according to claim 1, wherein the blade extends in a height direction and is in the form of, in the height direction, a root and an airfoil, the first gasket being fastened on the root and extending in a direction that is substantially perpendicular to the height direction.

4. The rotor wheel according to claim 1, wherein the first gasket includes a linear base and a linear lip extending from the linear base, and wherein the linear base is fastened on the blade, while the distal end of the linear lip is formed as a flyweight.

5. The rotor wheel according to claim 1, wherein the first gasket is bonded to the body.

6. The rotor wheel according to claim 1, wherein the body of the blade is made of composite material.

7. The rotor wheel according to claim 1, wherein the second gasket is linear.

8. A turbomachine comprising a rotor wheel according to claim 1.

* * * * *